US011594358B2

(12) United States Patent
Miyamoto

(10) Patent No.: US 11,594,358 B2
(45) Date of Patent: Feb. 28, 2023

(54) DIFFERENTIAL MODE CHOKE COIL COMPONENT

(71) Applicant: Murata Manufacturing Co., Ltd., Kyoto-fu (JP)

(72) Inventor: Masashi Miyamoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 468 days.

(21) Appl. No.: 16/787,937

(22) Filed: Feb. 11, 2020

(65) Prior Publication Data

US 2020/0265985 A1 Aug. 20, 2020

(30) Foreign Application Priority Data

Feb. 16, 2019 (JP) ..... JP2019-026129

(51) Int. Cl.
*H01F 17/04* (2006.01)
*H01F 27/29* (2006.01)
*H01F 17/00* (2006.01)

(52) U.S. Cl.
CPC ..... *H01F 17/045* (2013.01); *H01F 27/292* (2013.01); *H01F 2017/0093* (2013.01)

(58) Field of Classification Search
CPC ..... H01F 17/045; H01F 27/292; H01F 2017/0093
See application file for complete search history.

(56) References Cited

U.S. PATENT DOCUMENTS

2003/0071704 A1* 4/2003 Toi ..... H01F 27/36 336/83
2008/0204172 A1* 8/2008 Sakai ..... H04B 3/30 333/22 R
2016/0054639 A1* 2/2016 Kono ..... G02F 1/2257 385/2
2017/0288626 A1* 10/2017 Kobayashi ..... H01F 27/006
2018/0019046 A1* 1/2018 Miyamoto ..... H01F 3/14
2018/0097497 A1* 4/2018 Kobayashi ..... H03H 1/0007
2018/0182528 A1 6/2018 Miyamoto
(Continued)

FOREIGN PATENT DOCUMENTS

JP 2005-019716 A 1/2005
JP 2005-39446 A 2/2005
JP 2011-146732 A 7/2011
JP 2011234255 A * 11/2011
JP 5105317 B2 12/2012
(Continued)

OTHER PUBLICATIONS

An Office Action; "Notice of Reasons for Refusal," mailed by the Japanese Patent Office dated Oct. 12, 2021, which corresponds to Japanese Patent Application No. 2019-026129 and is related to U.S. Appl. No. 16/787,937 with English translation.

*Primary Examiner* — Elvin G Enad
*Assistant Examiner* — Malcolm Barnes
(74) *Attorney, Agent, or Firm* — Studebaker & Brackett PC

(57) ABSTRACT

A differential mode choke coil component includes a substantially drum-shaped core, a substantially plate-shaped core, and first and second wires. The plate-shaped core is secured to each of the first and second flanges by using an adhesive with the first major surface facing the top surface of each of the first and second flanges with a spacing. The spacing has a mean value greater than or equal to about 20 μm between the first major surface and the top surface of each of the first and second flanges.

7 Claims, 5 Drawing Sheets

(56) References Cited

U.S. PATENT DOCUMENTS

| | | | | |
|---|---|---|---|---|
| 2020/0013545 | A1* | 1/2020 | Takahashi | H01F 3/14 |
| 2020/0105451 | A1* | 4/2020 | Horie | H01F 17/045 |

FOREIGN PATENT DOCUMENTS

| | | | |
|---|---|---|---|
| JP | 2016-174058 | A | 9/2016 |
| JP | 2018-10999 | A | 1/2018 |
| JP | 2018-060903 | A | 4/2018 |
| JP | 2018-107248 | A | 7/2018 |

* cited by examiner

DIFFERENTIAL MODE CHOKE COIL COMPONENT

CROSS-REFERENCE TO RELATED APPLICATION

This application claims benefit of priority to Japanese Patent Application No. 2019-026129, filed Feb. 16, 2019, the entire content of which is incorporated herein by reference.

BACKGROUND

Technical Field

The present disclosure relates to a differential mode choke coil component used to block differential mode signals, in particular, a differential mode choke coil component including a substantially drum-shaped core around which two wires are wound, and a substantially plate-shaped core disposed between flanges located in opposite end portions of the drum-shaped core.

Background Art

An exemplary differential mode choke coil component is disclosed in Japanese Unexamined Patent Application Publication No. 2018-060903. FIG. 7, which is cited from FIG. 1 in Japanese Unexamined Patent Application Publication No. 2018-060903, is a perspective view of a differential mode choke coil component (to be sometimes referred to simply as "choke coil component" hereinafter) 1, illustrating the outward appearance of the differential mode choke coil component 1 as viewed from its side to be mounted.

As illustrated in FIG. 7, the choke coil component 1 includes a substantially drum-shaped core 5, a substantially plate-shaped core 8, and a first wire 9 and a second wire 10. The substantially drum-shaped core 5 is made of a magnetic material such as ferrite, and has a core portion 2, and a first flange 3 and a second flange 4 provided in opposite end portions of the core portion 2. The plate-shaped core 8 is made of a magnetic material such as ferrite, and has a first major surface 6 and a second major surface 7 that face in opposite directions. The first wire 9 and the second wire 10 are wound around the core portion 2 in opposite directions.

A first terminal electrode 11 and a third terminal electrode 13 are disposed on the first flange 3, and a second terminal electrode 12 and a fourth terminal electrode 14 are disposed on the second flange 4. Opposite end portions of the first wire 9 are respectively connected to the first terminal electrode 11 and the second terminal electrode 12, and opposite end portions of the second wire 10 are respectively connected to the third terminal electrode 13 and the fourth terminal electrode 14.

The first and second flanges 3 and 4 respectively have bottom surfaces 15 and 16, which are directed to face a mounting substrate when the differential mode choke coil component 1 is mounted onto the mounting substrate, and top surfaces 17 and 18 respectively located opposite to the bottom surfaces 15 and 16. The terminal electrodes 11 to 14 are each located on the bottom surface 15 or 16 of the flange 3 or 4.

The plate-shaped core 8 is secured to the first and second flanges 3 and 4 by using an adhesive with the first major surface 6 facing the top surfaces 17 and 18. The plate-shaped core 8 thus forms a closed magnetic circuit in cooperation with the drum-shaped core 5.

FIG. 8 illustrates an example of how the choke coil component 1 is used. FIG. 8 depicts transmission lines TL1 and TL2 extending from a port P1 on the input side to a port P2 on the output side. A common mode choke coil component CC for removing common mode noise is disposed in series on the transmission lines TL1 and TL2. In an area located closer to the port P1 than is the common mode choke coil component CC, a first shunt element S1 is inserted between ground and each of the transmission lines TL1 and TL2, and in an area located closer to the port P2 than is the common mode choke coil component CC, a second shunt element S2 is inserted between ground and each of the transmission lines TL1 and TL2. Each of the shunt elements S1 and S2 prevents a differential mode signal that travels from the port P1 to the port P2, for example, a power supply signal, from passing through the shunt element to ground. Each of the shunt elements S1 and S2 also functions as a filter that shunts, to ground, common mode noise propagating on each of the transmission lines TL1 and TL2, in particular, common mode noise reflected by the common mode choke coil component CC, thus ensuring that the common mode noise does not travel toward the port P1 or the port P2.

In FIG. 8, a resistive element R is connected between the first shunt element S1 and ground. The resistance of the resistive element R varies with the required filter characteristics, and can be substantially zero in some cases. Although not illustrated, depending on the required filter characteristics, such a resistive element may be connected between the second shunt element S2 and ground.

For example, the differential mode choke coil component 1 illustrated in FIG. 7 is used as each of the shunt elements S1 and S2. In this case, for example, the first terminal electrode 11 of each differential mode choke coil component 1 is connected to the transmission line TL1, the third terminal electrode 13 is connected to the other transmission line TL2, and the second and fourth terminal electrodes 12 and 14 are directly or indirectly connected to ground.

SUMMARY

However, the present inventor has found that even if the differential mode choke coil component 1 as illustrated in FIG. 7 is used as each of the shunt elements S1 and S2 for the purpose of blocking differential mode signals on the transmission lines TL1 and TL2 illustrated in FIG. 8, the intended purpose may not be achieved in some cases.

Firstly, if the differential mode choke coil component 1 illustrated in FIG. 7 is to be used as each of the shunt elements S1 and S2, it is necessary to minimize the stray capacitance between the first and second wires 9 and 10. This is because the above-mentioned stray capacitance in the differential mode choke coil component 1 is equivalent to a capacitance inserted between the transmission lines TL1 and TL2, that is, between positive and negative lines, and thus the stray capacitance causes a decrease in characteristic impedance of the transmission lines TL1 and TL2, leading to deterioration of signal transmission characteristics.

Secondly, for the shunt elements S1 and S2 inserted between the transmission lines TL1 and TL2, it is necessary to reduce signal distortion that is generated by the drum-shaped core 5 and the plate-shaped core 8 made of a magnetic material such as ferrite upon passage of direct current or alternating current. This is because any such signal distortion results in noise generation.

FIGS. 9A and 9B each illustrate the frequency characteristics of noise. FIG. 9A illustrates noise for a case where no shunt element is inserted, and FIG. 9B illustrates noise for a case where a differential mode choke coil component is inserted as each of the shunt elements S1 and S2. A comparison between FIGS. 9A and 9B reveals that noise is actually greater for the case where a differential mode choke coil component, which is intended as a noise suppression component, is inserted than for the case where no differential mode choke coil component is inserted.

Accordingly, the present disclosure provides a differential mode choke coil component capable of reducing signal distortion caused by a magnetic material without increasing stray capacitance generated between individual wires.

According to one embodiment of the present disclosure, there is provided a differential mode choke coil component connected in shunt with a signal transmission line including a first line and a second line, the differential mode choke coil component including a substantially drum-shaped core, a substantially plate-shaped core, and a first wire and a second wire. The drum-shaped core is made of a magnetic material, and has a core portion, and a first flange and a second flange. The core portion has opposite end portions including a first end portion and a second end portion. The first and second flanges are respectively provided in the first and second end portions of the core portion. The plate-shaped core is made of a magnetic material, and has a first major surface and a second major surface that face in opposite directions. The first wire and the second wire wound around the core portion.

In the differential mode choke coil component mentioned above, the first and second wires each have a first end portion and a second end portion, the first end portion of the first wire is electrically connected to the first line, the first end portion of the second wire is electrically connected to the second line, and the respective second end portions of the first and second wires are electrically connected to ground. For signals in phase with each other and flowing in the first line and the second line, magnetic fluxes generated in the core portion by the first wire and the second wire are directed to cancel out each other, and for signals in opposite phase to each other and flowing in the first line and the second line, magnetic fluxes generated in the core portion by the first wire and the second wire are directed to reinforce each other.

The first and second flanges each have a bottom surface and a top surface. The bottom surface is directed to face a mounting substrate when the differential mode choke coil component is mounted onto the mounting substrate. The top surface is located opposite to the bottom surface. The plate-shaped core is secured to each of the first and second flanges by using an adhesive with the first major surface facing the top surface of each of the first and second flanges with a spacing, the spacing having a mean value greater than or equal to about 20 μm between the first major surface and the top surface of each of the first and second flanges.

Other features, elements, characteristics and advantages of the present disclosure will become more apparent from the following detailed description with reference to the attached drawings.

DETAILED DESCRIPTION

Figure 7:
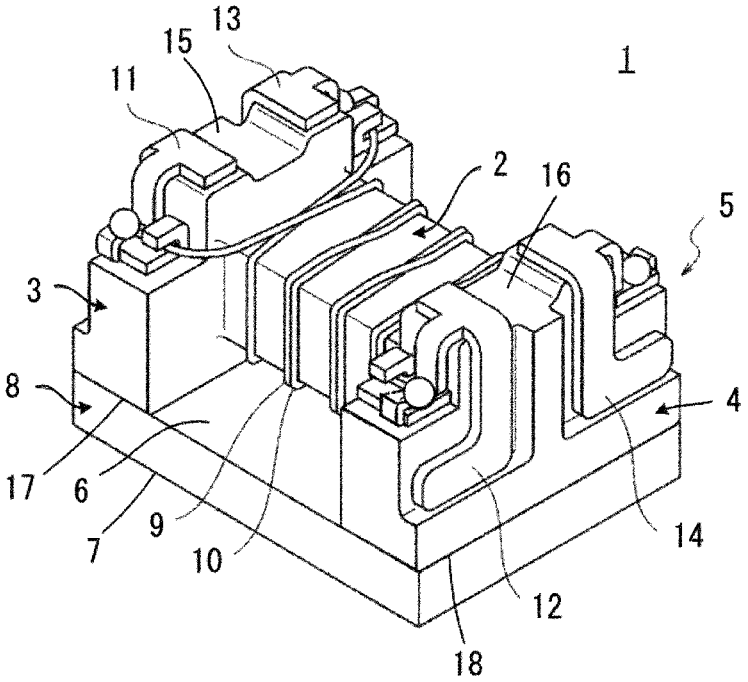
FIG. 7 is a plan view of a differential mode choke coil component according to related art described in Japanese Unexamined Patent Application Publication No. 2018-060903, illustrating the outward appearance of the differential mode choke coil component with its mounting surface directed to face a mounting substrate being depicted at top.

First, with reference to FIGS. 7 and 8 mentioned above, noise generated by a differential mode choke coil component intended as a noise suppression component will be discussed below.

To avoid radiation of generated noise, a closed magnetic circuit structure is required. A completely closed magnetic circuit, such as the magnetic circuit formed by the drum-shaped core 5 and the plate-shaped core 8 of the differential mode choke coil component 1 illustrated in FIG. 7, causes magnetic field to stay within the drum-shaped core 5 and the plate-shaped core 8, thus reducing radiation from the choke coil component 1. However, with a closed magnetic circuit such as the magnetic circuit formed in the differential mode choke coil component 1 illustrated in FIG. 7, an excessively strong magnetic flied is generated, which causes distortion of a signal itself due to the hysteresis characteristics of the magnetic material such as ferrite. As the distorted signal is carried on the transmission lines TL1 and TL2 illustrated in FIG. 8, noise increases.

One way to address this would be to reduce generated magnetic flux such as by covering the entire differential mode choke coil component 1 with magnetic particles having low magnetic permeability μ. This approach, however, has two problems. First, magnetic particles have very low magnetic permeability μ, and the resulting low internal coupling coefficient means that noise is emitted to the surroundings in the form of magnetic field coupling. Second, magnetic particles have high dielectric constant ε and are directly applied onto the periphery of each wire, resulting in increased stray capacitance between individual wires.

Under the above-mentioned background, a differential mode choke coil component according to embodiments of the present disclosure will now be described below.

With reference to FIGS. 1 to 4, a differential mode choke coil component 21 (to be sometime referred to simply as "choke coil component" hereinafter) according to a first embodiment of the present disclosure will be described below.

Figure 1:
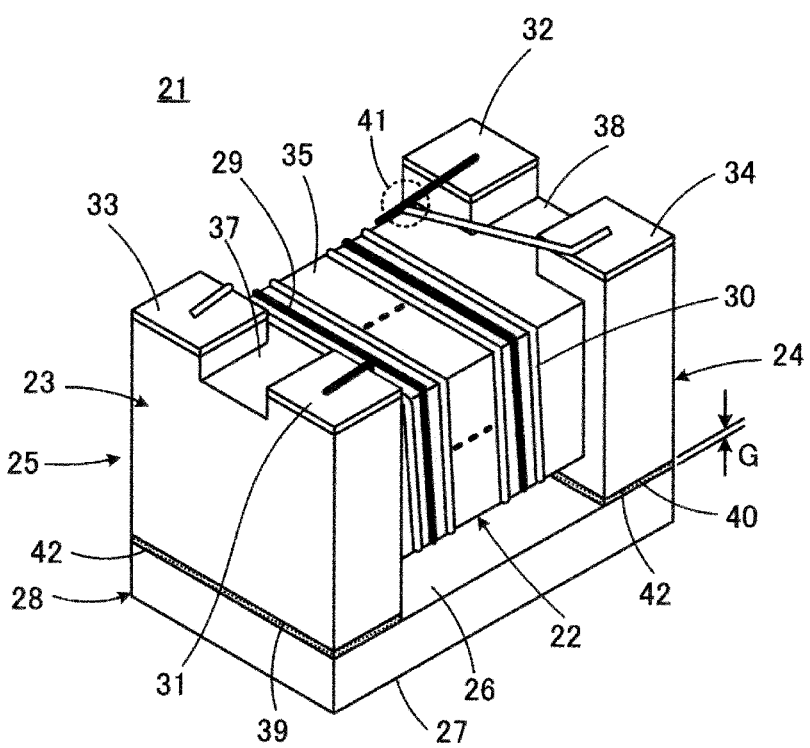
FIG. 1 is a perspective view of a differential mode choke coil component according to a first embodiment of the present disclosure, illustrating the outward appearance of the differential mode choke coil component with its mounting surface directed to face a mounting substrate being depicted at top.
Figure 2:
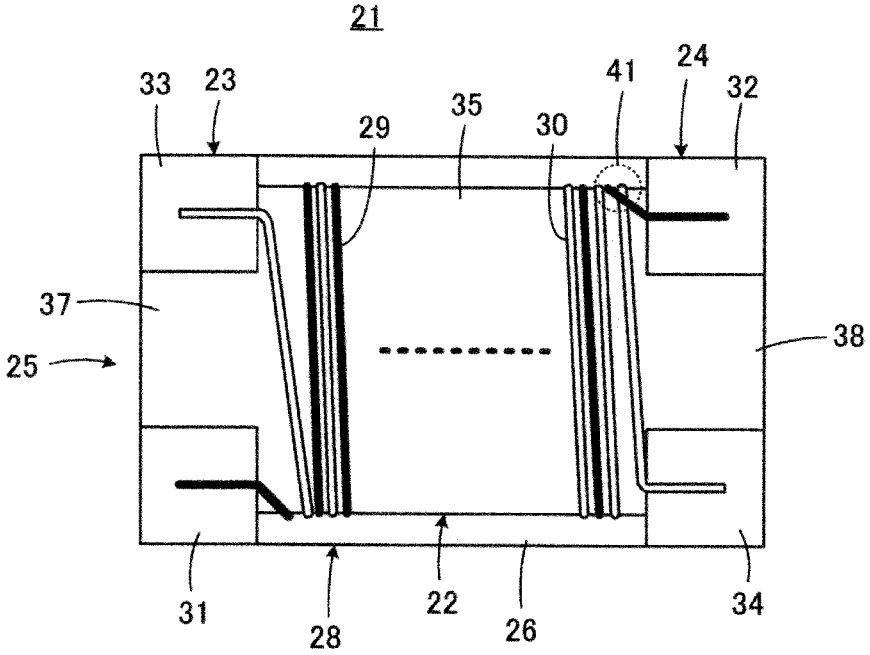
FIG. 2 is a plan view of the differential mode choke coil component illustrated in FIG. 3 with the mounting surface directed to face the mounting substrate being depicted at front.

The choke coil component 21 includes a substantially drum-shaped core 25, a substantially plate-shaped core 28, and a first wire 29 and a second wire 30. The substantially drum-shaped core 25 is made of a magnetic material such as ferrite, and has a core portion 22, and a first flange 23 and a second flange 24 respectively provided in first and second end portions of the core portion 22, which are opposite end portions of the core portion 22. The plate-shaped core 28 is made of a magnetic material such as ferrite, and has a first major surface 26 and a second major surface 27 that face in opposite directions. The first wire 29 and the second wire 30 are wound around the core portion 22 in opposite directions. In FIGS. 1 and 2, to facilitate clear distinction between the first wire 29 and the second wire 30, the first wire 29 is shown filled-in, and the second wire 30 is shown hollow.

The first wire 29 and the second wire 30 are each formed by, for example, a substantially linear central conductor made of a copper wire with a diameter not less than about 0.02 mm and not greater than about 0.080 mm (i.e., from about 0.02 mm to about 0.080 mm) that is covered with, for example, an electrically insulating resin such as polyurethane, imide-modified polyurethane, polyesterimide, or polyamideimide.

One characteristic feature of the first wire 29 and the second wire 30, which are wound on the core portion 22 in a substantially helical fashion, is that the two wires are wound in the same direction. The first and second wires 29 and 30 can be thus wound on the core portion 22 simultaneously in manufacturing the choke coil component 21, leading to increased manufacturing efficiency.

A first terminal electrode 31 and a third terminal electrode 33 are disposed on the first flange 23, and a second terminal electrode 32 and a fourth terminal electrode 34 are disposed on the second flange 24. Although the terminal electrodes 31 to 34 are each formed by, for example, a method such as baking of a conductive paste or plating of a conductive metal, alternatively, the terminal electrodes 31 to 34 may each be provided by bonding a separately prepared metal terminal component onto the flange 23 or 24. Opposite end portions of the first wire 29 are respectively connected to the first terminal electrode 31 and the second terminal electrode 32 while being extended to a mounting surface 35, which is a surface of the drum-shaped core 25 directed to face a mounting substrate on which to mount the choke coil component 21. Opposite end portions of the second wire 30 are respectively connected to the third terminal electrode 33 and the fourth terminal electrode 34 while being extended to the mounting surface 35.

The first flange 23 and the second flange 24 respectively have bottom surfaces 37 and 38, which are directed to face the mounting substrate when the choke coil component 21 is mounted onto the mounting substrate, and top surfaces 39 and 40 respectively located opposite to the bottom surfaces 37 and 38. The terminal electrodes 31 to 34 are each disposed on the bottom surface 37 or 38 of the flange 23 or 24. In the first embodiment, the mounting surface 35 is flush with the respective bottom surfaces 37 and 38 of the flanges 23 and 24, and the terminal electrodes 31 to 34 are each disposed on a projection projecting in a stepped fashion from a portion of the bottom surface 37 or 38 of the flange 23 or 24.

The terminal electrodes 31 to 34 are positioned as described below. When an imaginary substantially rectangular shape is drawn on the mounting surface 35, the four terminal electrodes 31 to 34 are each located at one of the four vertices of the rectangular shape, with the first and third terminal electrodes 31 and 33 being located on the first flange 23, and the second and fourth terminal electrodes 32 and 34 being located on the second flange 24. The first and second terminal electrodes 31 and 32 are positioned to face each other in a substantially diagonal direction, and the third and fourth terminal electrodes 33 and 34 are positioned to face each other in a substantially diagonal direction.

As a result of the above-mentioned positioning of the terminal electrodes 31 to 34, an intersecting portion 41 (illustrated particularly well in FIG. 2) where the first and second wires 29 and 30 intersect each other once on the core portion 22 is formed at the beginning end or terminating end of the winding of each of the first and second wires 29 and 30.

Figure 3:
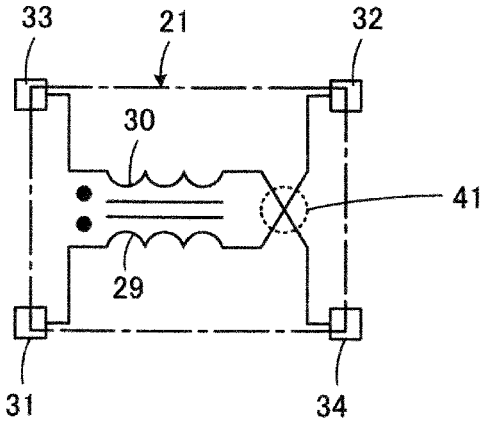
FIG. 3 is an equivalent circuit diagram of the differential mode choke coil component illustrated in FIGS. 1 and 2.

An equivalent circuit as illustrated in FIG. 3 is implemented with the choke coil component 21. Elements in FIG. 3 corresponding to elements illustrated in FIG. 1 or 2 are denoted by like reference symbols, and will not be described in further detail.

In FIG. 3, the first terminal electrode 31, the second terminal electrode 32, the third terminal electrode 33, and the fourth terminal electrode 34 are positioned in the same manner as in FIGS. 1 and 2. FIG. 3 depicts the intersecting portion 41 of the winding of each of the first and second wires 29 and 30.

The differential mode choke coil component 21 is designed to block differential mode signals. As such, for example, the differential mode choke coil component 21 is inserted in shunt with a differential signal line. More specifically, if the differential mode choke coil component 21 is to be used as each of the shunt elements S1 and S2 illustrated in FIG. 8, for example, the first terminal electrode 31 of each differential mode choke coil component 21 is electrically connected to the transmission line TL1, the fourth terminal electrode 34 is electrically connected to the other transmission line TL2, and the second and third terminal electrodes 32 and 33 are electrically connected to ground. Only planar wiring is required to achieve such a wiring arrangement on a mounting substrate, and there is no need to employ complicated routing for the wiring such as making individual wiring components intersect each other. This may contribute to improving high frequency characteristics and minimizing unwanted stray capacitance.

Figure 8:
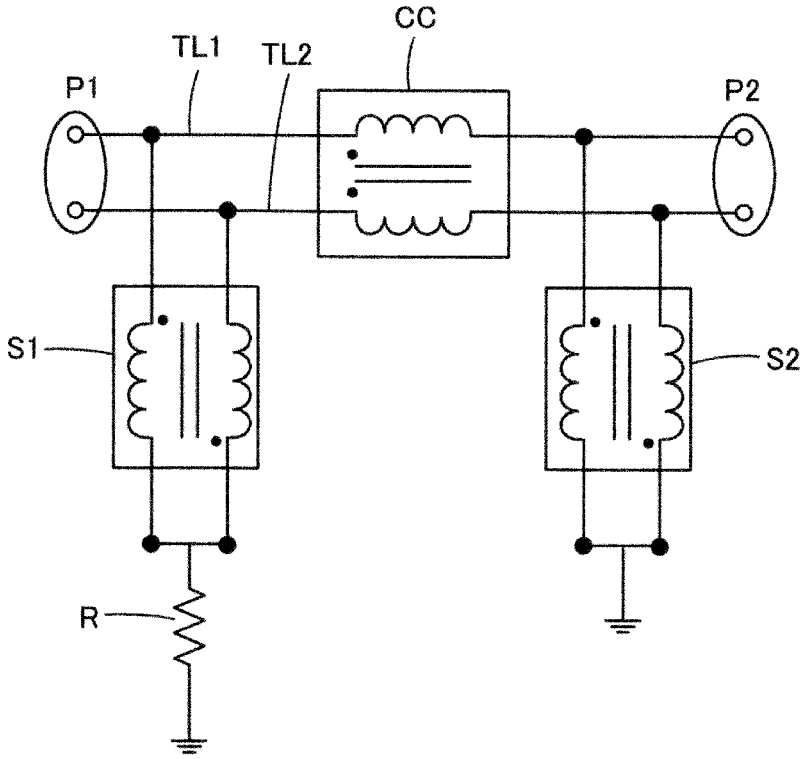
FIG. 8 is a circuit diagram illustrating an exemplary case where a differential mode choke coil component is used as each shunt element.
Figure 9A:
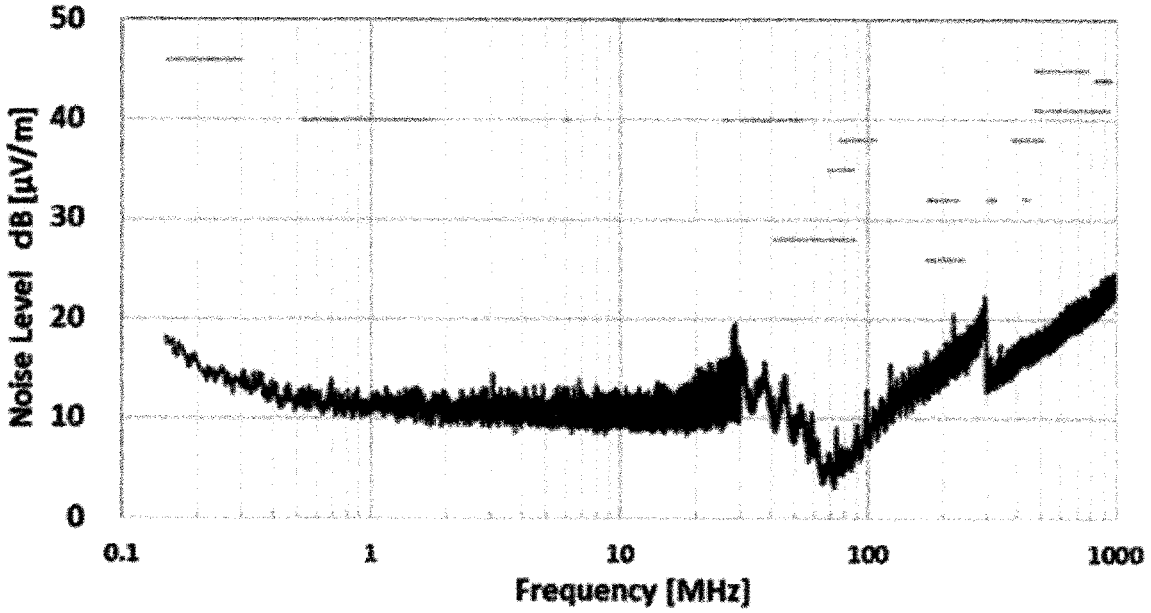
FIGS. 9A illustrates the frequency characteristics of noise for a case where no shunt element is inserted.
Figure 9B:
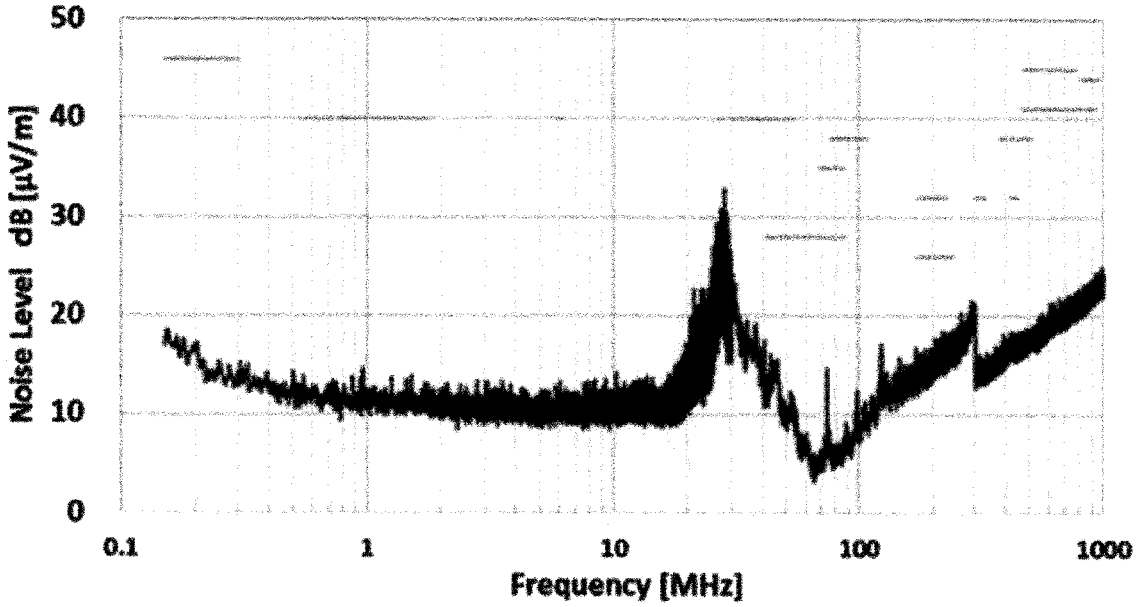
FIG. 9B illustrates the frequency characteristics of noise for a case where a differential mode choke coil component according to related art is inserted as each shunt element illustrated in FIG. 8.

When the differential mode choke coil component 21 is used as each of the shunt elements S1 and S2 illustrated in FIG. 8, for signals in phase with each other and flowing in the first transmission line TL1 and the second transmission line TL2 illustrated in FIG. 8, magnetic fluxes generated in the core portion 22 by the first wire 29 and the second wire 30 are directed to cancel out each other, and for signals in opposite phase to each other and flowing in the first transmission line TL1 and the second transmission line TL2, magnetic fluxes generated in the core portion 22 by the first wire 29 and the second wire 30 are directed to reinforce each other.

More specifically, if a current flowing from the first terminal electrode 31 toward the second terminal electrode 32, and a current flowing from the third terminal electrode 33 toward the fourth terminal electrode 34 are in phase with each other, magnetic fluxes generated in the core portion 22 by the first wire 29 and the second wire 30 are directed to cancel out each other, and if a current flowing from the first terminal electrode 31 toward the second terminal electrode 32, and a current flowing from the third terminal electrode 33 toward the fourth terminal electrode 34 are in opposite phase to each other, magnetic fluxes generated in the core portion 22 by the first wire 29 and the second wire 30 are directed to reinforce each other.

In the choke coil component 21 according to the first embodiment described above, the position of the intersecting portion 41 of the first and second wires 29 and 30 may be changed such that the intersecting portion 41 is located at a substantially halfway point of the total number of turns of the first wire 29 on the core portion 22 and at a substantially halfway point of the total number of turns of the second wire 30 on the core portion 22. This enhances the symmetry of the relative position of the first wire 29 and the second wire 30, leading to enhanced characteristics.

The term "substantially halfway point of the total number of turns" mentioned above refers to a position corresponding to substantially one-half of the total number of turns, and is determined with reference to the number of turns. In this regard, considering factors such as the total number of turns being an odd number, or loss of symmetry of the relative position of the first wire 29 and the second wire 30 at the beginning or end of the winding of each wire, the "position corresponding to substantially one-half of the total number of turns" may not necessarily be precise. Specifically, the intersecting portion 41 may be located at a position displaced by one or two turns with respect to the position corresponding to exactly one-half of the total number of turns.

The plate-shaped core 28 and characteristic features associated with the plate-shaped core 28 will be described below.

Figure 4:
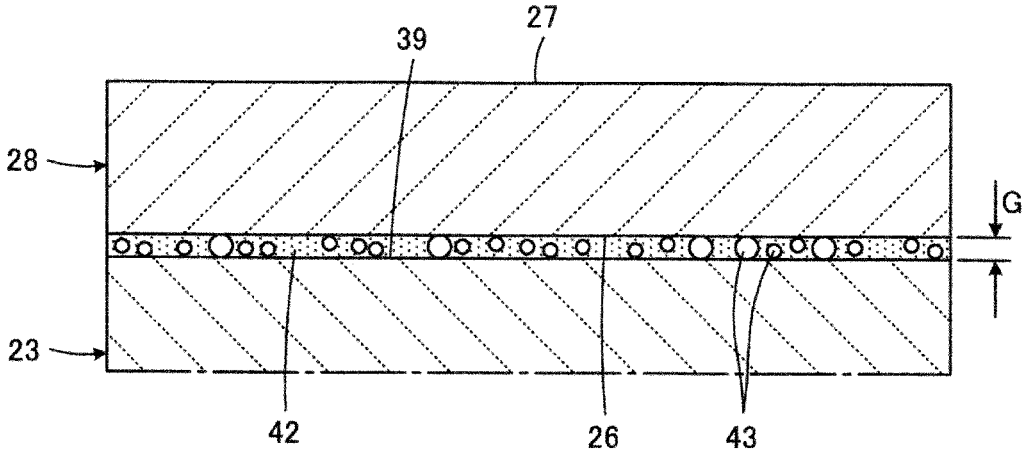
FIG. 4 is a cross-sectional view of the differential mode choke coil component illustrated in FIGS. 1 and 2, illustrating in enlarged detail a portion of the differential mode choke coil component where a substantially plate-shaped core and a first flange are bonded to each other.

The plate-shaped core 28 is secured to each of the first and second flanges 23 and 24 with an adhesive 42. At this time, the first major surface 26 of the plate-shaped core 28 faces the respective top surfaces 39 and 40 of the flanges 23 and 24. In this regard, a spacing G with a mean value greater than or equal to about 20 μm is provided between the first major surface 26 of the plate-shaped core 28, which forms a closed magnetic circuit in cooperation with the drum-shaped core 25, and the respective top surfaces 39 and 40 of the flanges 23 and 24. In FIGS. 1 and 4, the spacing G is depicted in somewhat exaggerated scale.

Although providing a mean spacing of about 20 μm or more between the plate-shaped core 28 and each of the flanges 23 and 24 as described above results in reduced magnetic flux generation, this configuration makes it possible to reduce hysteresis distortion of the magnetic material such as ferrite forming each of the drum-shaped core 25 and the plate-shaped core 28. Therefore, generation of noise due to hysteresis distortion can be reduced. The decrease in generated magnetic flux can be compensated for by increasing the number of turns of each of the wires 29 and 30.

The term "mean value greater than or equal to about 20 μm" as used with reference to the spacing G means that, for a sample obtained by polishing the choke coil component 21 such that a surface parallel to the end face of one of the flanges 23 and 24 appears, when the spacing G is measured at, for example, five points set at equal intervals in the widthwise direction, the arithmetic mean of these measurements is "greater than or equal to about 20 μm". In setting the above-mentioned five points, rounded portions at the edges of the flanges 23 and 24 and areas in their vicinity are avoided to ensure that the measurement results reflect a substantially mean value of the spacing.

The upper limit of the spacing G is preferably set to about 60 μm. If the spacing G is greater than about 60 μm, the improvement in inductance achieved by providing the plate-shaped core 28 is at most twice or less of that when the plate-shaped core 28 is not provided, and thus there is not much point in providing the plate-shaped core 28.

The spacing G with a mean value greater than or equal to about 20 μm is not achieved unless such a spacing G is intentionally provided. Examples of adhesives commonly used to bond the plate-shaped core 28 with each of the flanges 23 and 24 include non-filler-containing adhesives, adhesives containing silica fillers for ease of filling, and filler type hardener-containing adhesives. If a non-filler-containing adhesive is used, the resulting spacing G is less than or equal to about 5 μm. If a silica-filler-containing adhesive is used, the resulting spacing G is about 10 μm. If a filler type hardener-containing adhesive is used, the resulting spacing G is less than about 20 μm. Therefore, as long as adhesives commonly used in related art are used, a spacing G greater than or equal to about 20 μm is not achieved.

In the first embodiment, to provide the spacing G greater than or equal to about 20 μm, as illustrated in FIG. 4, the adhesive 42 containing spacer particles 43 is used. The spacer particles 43 have a diameter not less than several μm and not more than several hundred μm (i.e., from several μm to several hundred μm), and may be made of, for example, a silica or filler type hardener with an intentionally increased diameter.

Figure 5:
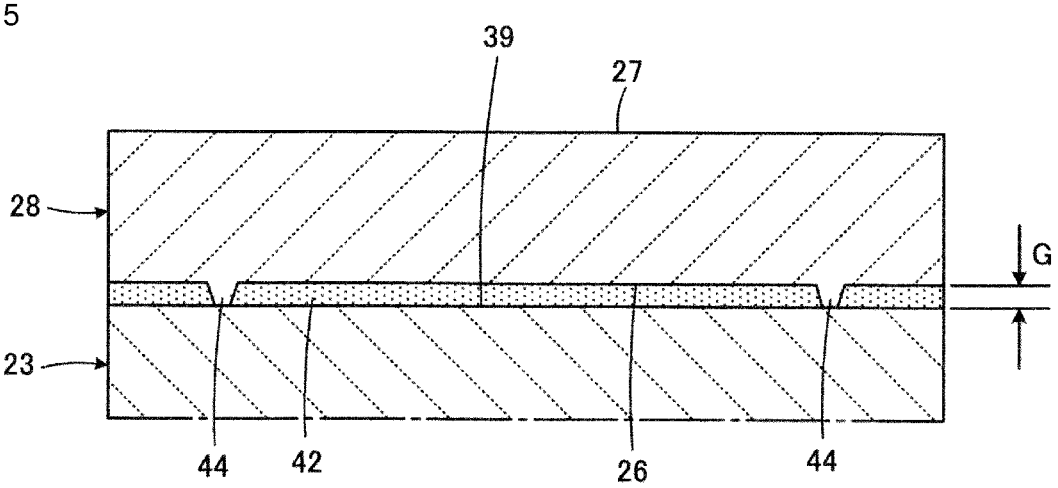
FIG. 5 is a cross-sectional view of a differential mode choke coil component according to a second embodiment of the present disclosure, illustrating in enlarged detail a portion of the differential mode choke coil component where a substantially plate-shaped core and a first flange are bonded to each other.

According to a second embodiment of the present disclosure, instead of or in addition to the spacer particles 43, a plurality of protrusions 44 may be provided on the first major surface 26 of the plate-shaped core 28 at positions facing the respective top surfaces 39 and 40 of the flanges 23 and 24 as illustrated in FIG. 5. The protrusions 44 contact the respective top surfaces 39 and 40 of the flanges 23 and 24 to thereby provide the spacing G greater than or equal to about 20 μm.

Although each protrusion 44 has the shape of, for example, a substantially circular truncated cone, each protrusion 44 may have other shapes, such as a substantially circular cylindrical shape, a substantially prismatic shape, or a substantially hemispheric shape. The protrusions 44 may be provided not on the plate-shaped core 28 but on the flanges 23 and 24, or may be provided on both the plate-shaped core 28 and the flanges 23 and 24. The positions at which to provide the protrusions 44 may be distributed between the plate-shaped core 28 and the flange 23 or the flange 24 such that for an area corresponding to the first flange 23, each protrusion 44 is provided on the plate-shaped core 28, and for an area corresponding to the second flange 24, each protrusion 44 is provided on the top surface 40.

It is preferred that the number of contact points between the plate-shaped core 28 and each of the flanges 23 and 24 be as small as possible, and that the area of their contact be as small as possible. Accordingly, it is preferred that the number of protrusions 44 be as small as possible, and that the cross-sectional area of each protrusion 44 be as small as possible. In this sense, in providing the spacing G, it is more preferable to use the adhesive 42 containing the spacer particles 43 as in the first embodiment than to provide the protrusions 44.

Although FIGS. 4 and 5 illustrate the area where the plate-shaped core 28 and the first flange 23 are bonded to each other, the area where the plate-shaped core 28 and the second flange 24 are bonded to each other has the same structure as mentioned above.

Figure 6:
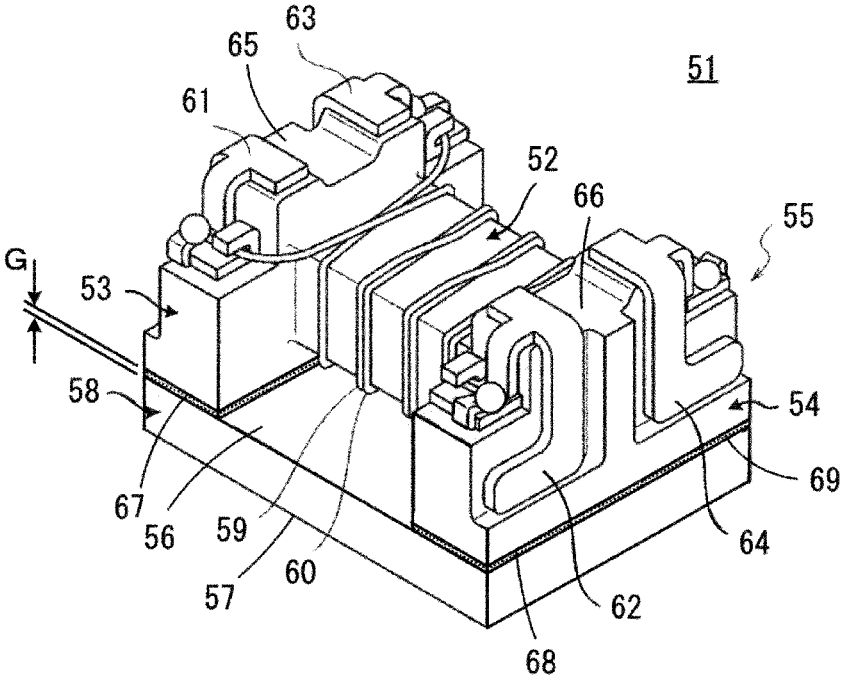
FIG. 6 is a perspective view of a differential mode choke coil component according to a third embodiment of the present disclosure, illustrating the outward appearance of the differential mode choke coil component with its mounting surface directed to face a mounting substrate being depicted at top.

FIG. 6 illustrates a differential mode choke coil component 51 according to a third embodiment of the present disclosure. The differential mode choke coil component 51 illustrated in FIG. 6 has basically the same configuration as the differential mode choke coil component 1 described above with reference to FIG. 7.

With reference to FIG. 6, the description of the basic configuration of the choke coil component 51 is repeated below. The choke coil component 51 includes a substantially drum-shaped core 55, a substantially plate-shaped core 58, and a first wire 59 and a second wire 60. The substantially drum-shaped core 55 is made of a magnetic material such as ferrite, and has a core portion 52, and a first flange 53 and a second flange 54 provided in opposite end portions of the core portion 52. The plate-shaped core 58 is made of a magnetic material such as ferrite, and has a first major surface 56 and a second major surface 57 that face in opposite directions. The first wire 59 and the second wire 60 are wound around the core portion 52 in opposite directions.

A first terminal electrode 61 and a third terminal electrode 63 are disposed on the first flange 53, and a second terminal electrode 62 and a fourth terminal electrode 64 are disposed on the second flange 54. Although the terminal electrodes 61 to 64 are each provided by, for example, bonding a separately prepared metal terminal component onto the flange 53 or 54, alternatively, the terminal electrodes 61 to 64 may each be formed by a method such as baking of a conductive paste or plating of a conductive metal. Opposite end portions of the first wire 59 are respectively connected to the first terminal electrode 61 and the second terminal electrode 62, and opposite end portions of the second wire 60 are respectively connected to the third terminal electrode 63 and the fourth terminal electrode 64.

The first flange 53 and the second flange 54 respectively have bottom surfaces 65 and 66, which are directed to face the mounting substrate when the differential mode choke coil component 51 is mounted onto the mounting substrate, and top surfaces 67 and 68 respectively located opposite to the bottom surfaces 65 and 66. The terminal electrodes 61 to 64 are each located on the bottom surface 65 or 66 of the flange 53 or 54.

The plate-shaped core 58 is secured to the first flange 53 and the second flange 54 by using an adhesive 69 with the first major surface 56 facing the top surfaces 67 and 68. In this regard, a spacing G with a mean value greater than or equal to about 20 μm is provided between the first major surface 56 of the plate-shaped core 58, which forms a closed magnetic circuit in cooperation with the drum-shaped core 55, and the respective top surfaces 67 and 68 of the flanges 53 and 54.

The following methods may be employed to provide the above-mentioned spacing G greater than or equal to about 20 μm: adding the spacer particles 43 as illustrated in FIG. 4 to the adhesive 69 as with the first embodiment; and providing the protrusions 44 as illustrated in FIG. 5 on the first major surface 56 of the plate-shaped core 58 at positions facing the respective top surfaces 67 and 68 of the flanges 53 and 54 or providing the protrusions 44 on the respective top surfaces 67 and 68 of the flanges 53 and 54.

If the differential mode choke coil component 51 is to be used as each of the shunt elements S1 and S2 illustrated in FIG. 8 to block differential mode signals, for example, the first terminal electrode 61 of each differential mode choke coil component 51 is connected to the transmission line TL1, the third terminal electrode 63 is connected to the other transmission line TL2, and the second and fourth terminal electrodes 62 and 64 are directly or indirectly connected to ground.

It is to be noted that although the present disclosure has been described above in association with various illustrated embodiments, the illustrated embodiments are for illustrative purposes only, and some features or elements described with respect to different embodiments may be substituted for or combined with one another.

While preferred embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A differential mode choke coil component connected in shunt with a signal transmission line including a first line and a second line, the differential mode choke coil component comprising:

a substantially drum-shaped core made of a magnetic material, the drum-shaped core having a core portion, and a first flange and a second flange, the core portion having opposite end portions including a first end portion and a second end portion, the first and second flanges being respectively provided in the first and second end portions of the core portion;

a substantially plate-shaped core made of a magnetic material, the plate-shaped core having a first major surface and a second major surface that face in opposite directions; and a first wire and a second wire that are wound around the core portion, wherein the first and second wires each have a first end portion and a second end portion, the first end portion of the first wire is electrically connected to the first line, the first end portion of the second wire is electrically connected to the second line, and the respective second end portions of the first and second wires are electrically connected to ground, for signals in phase with each other and flowing in the first line and the second line, magnetic fluxes generated in the core portion by the first wire and the second wire are directed to cancel out each other, and for signals in opposite phase to each other and flowing in the first line and the second line, magnetic fluxes generated in the core portion by the first wire and the second wire are directed to reinforce each other, the first and second flanges each have a bottom surface and a top surface, the bottom surface being directed to face a mounting substrate when the differential mode choke coil component is mounted onto the mounting substrate, the top surface being located opposite to the bottom surface, the plate-shaped core is secured to each of the first and second flanges by using an adhesive with the first major surface facing the top surface of each of the first and second flanges with a spacing, the spacing having a mean value greater than or equal to about 20 μm between the first major surface and the top surface of each of the first and second flanges, the differential mode choke coil component further comprises:

a first terminal electrode and a second terminal electrode respectively connected with the first and second end portions of the first wire; and a third terminal electrode and a fourth terminal electrode respectively connected with the first and second end portions of the second wire, if a current flowing from the first terminal electrode toward the second terminal electrode, and a current flowing from the third terminal electrode toward the fourth terminal electrode are in phase with each other, magnetic fluxes generated in the core portion by the first wire and the second wire are directed to cancel out each other, and if a current flowing from the first terminal electrode toward the second terminal electrode, and a current flowing from the third terminal electrode toward the fourth terminal electrode are in opposite phase to each other, magnetic fluxes generated in the core portion by the first wire and the second wire are directed to reinforce each other.

2. The differential mode choke coil component according to claim 1, wherein the adhesive includes spacer particles.

3. The differential mode choke coil component according to claim 1, wherein in an area where the first major surface of the plate-shaped core and the top surface of each of the first and second flanges face each other, at least one of the first major surface of the plate-shaped core and the top surface of each of the first and second flanges includes a plurality of protrusions, the protrusions being in contact with another one of the first major surface of the plate-shaped core and the top surface of each of the first and second flanges.

4. The differential mode choke coil component according to claim 1, wherein the first and second wires are wound around the core portion in a same direction, and the drum-shaped core has a mounting surface directed to face the mounting substrate, and the first terminal electrode, the second terminal electrode, the third terminal electrode, and the fourth terminal electrode are positioned such that, when an imaginary substantially rectangular shape is drawn on the mounting surface, the first to fourth terminal electrodes are each located at one of four vertices of the rectangular shape, the first and third terminal electrodes are disposed on the first flange, the second and fourth terminal electrodes are disposed on the second flange, the first and second terminal electrodes are positioned to face each other in a substantially diagonal direction, and the third and fourth terminal electrodes are positioned to face each other in a substantially diagonal direction.

5. The differential mode choke coil component according to claim 4, wherein the first wire and the second wire each have an intersecting portion where the first and second wires intersect each other around the core portion, and the intersecting portion is located at a substantially halfway point of a total number of turns of the first wire on the core portion and at a substantially halfway point of a total number of turns of the second wire on the core portion.

6. The differential mode choke coil component according to claim 1, wherein the first wire and the second wire are wound around the core portion in opposite directions, and the drum-shaped core has a mounting surface directed to face the mounting substrate, and the first terminal electrode, the second terminal electrode, the third terminal electrode, and fourth terminal electrode are positioned such that, when an imaginary substantially rectangular shape is drawn on the mounting surface, the first to fourth terminal electrodes are each located at one of four vertices of the rectangular shape, the first and third terminal electrodes are disposed on the first flange, the second and fourth terminal electrodes are disposed on the second flange, the first and fourth terminal electrodes are positioned to face each other in a substantially diagonal direction, and the third and second terminal electrodes are positioned to face each other in a substantially diagonal direction.

7. The differential mode choke coil component according to claim 2, wherein in an area where the first major surface of the plate-shaped core and the top surface of each of the first and second flanges face each other, at least one of the first major surface of the plate-shaped core and the top surface of each of the first and second flanges includes a plurality of protrusions, the protrusions being in contact with another one of the first major surface of the plate-shaped core and the top surface of each of the first and second flanges.

* * * * *